United States Patent [19]

Prais

[11] Patent Number: 4,879,960

[45] Date of Patent: Nov. 14, 1989

[54] THREAD TRIMMER SYSTEM FOR IN-LINE CHAIN STITCH SEWING MACHINE

[75] Inventor: Eugene R. Prais, Hewitt, N.J.

[73] Assignee: Kansai Special USA Corp., Moonachie, N.J.

[21] Appl. No.: 223,119

[22] Filed: Jul. 22, 1988

[51] Int. Cl.[4] ..... D05B 57/04; D05B 65/02

[52] U.S. Cl. ..... 112/291; 112/199; 112/253; 112/254; 112/294; 112/297

[58] Field of Search ..... 112/254, 292, 286, 199, 112/253, 288, 294, 291, 297

[56] References Cited

U.S. PATENT DOCUMENTS

| | | | |
|---|---|---|---|
| 3,139,849 | 8/1961 | Cohen et al. . | |
| 3,324,812 | 6/1967 | Smith . | |
| 3,354,852 | 11/1967 | Kennedy . | |
| 3,424,117 | 1/1969 | Schopf | 112/292 |
| 3,532,065 | 10/1970 | Marforio . | |
| 3,688,716 | 9/1972 | Heimann et al. | 112/292 |
| 3,760,749 | 9/1973 | Trageser . | |
| 4,401,046 | 8/1983 | Bray . | |
| 4,455,957 | 6/1984 | Vollmar | 112/292 |
| 4,461,229 | 7/1984 | Angele et al. . | |
| 4,683,828 | 8/1987 | Matsumoto | 112/294 |
| 4,726,305 | 2/1988 | Seto | 112/199 X |

FOREIGN PATENT DOCUMENTS

| | | | |
|---|---|---|---|
| 282193 | 7/1967 | U.S.S.R. | 112/292 |
| 1119955 | 7/1968 | United Kingdom | 112/292 |

*Primary Examiner*—Andrew M. Falik

*Attorney, Agent, or Firm*—Killworth, Gottman, Hagan & Schaeff

[57] ABSTRACT

Apparatus and method for severing the needle and looper threads of a chain stitch formed by a sewing machine having an in-line looper system. The sewing machine has a needle plate and a needle carrying the needle thread through the material and the needle plate to form a needle loop of needle thread therebelow that has a needle side running to the needle. The apparatus comprises a stationary knife, a spring positioned below the stationary knife and biased in a direction toward the stationary knife, and a movable knife slidably mounted between the stationary knife and the spring which yieldingly urges the movable knife thereagainst. The movable knife has one penetrating end with a pair of axially offset barbs, a lagging barb and a leading barb closer to the penetrating end of the movable knife than the lagging barb. These three elements cooperate to hook and sever the needle side of the needle loop and the looper thread below the needle plate and prepare the looper thread for the next stitch.

11 Claims, 7 Drawing Sheets

THREAD TRIMMER SYSTEM FOR IN-LINE CHAIN STITCH SEWING MACHINE

BACKGROUND OF THE INVENTION

The present invention relates to a chain stitch sewing machine and, more particularly, to an in-line chain stitch sewing machine having a thread trimmer system which operates automatically below the needle plate.

The sewing machine of the present invention is used exclusively to form a chain stitch, which is well known in the art as a type 401 stitch, and is to be distinguished from machines forming other types of stitches such as, for example, a lock stitch formed by sewing machines disclosed in U.S. Pat. Nos. 3,139,849 and 4,401,046. The sewing machine of the present invention forms a chain stitch by using an in-line looper system which is distinguishable from a machine using a transverse looper system such as, for example, the machines disclosed in U.S. Pat. Nos. 3,354,852 and 3,532,065. A sewing machine using a transverse looper system forms the chain stitch by cycling through an elliptical path that is perpendicular to the direction of sewing. Because of the perpendicular relationship and ample space below the needle plate, trimmer systems cutting below the needle plate have been used on machines using the transverse looper system. The problem with using such machines, however, is that they are limited to about 5 needles and a small sewing width.

Machines using the in-line looper system, however, can use more than 30 needles and provide an unlimited sewing width. As such, they are more desirable for certain commercial applications. In such machines, however, the loopers move only in a straight line parallel machines, however, the loopers move only in a straight line parallel to the direction of sewing and, as such, require the use of an extra component, a set of coaxially aligned spreaders, to form the stitch by moving perpendicular to the direction of sewing. Because of the extra components, one spreader for each needle, there is little space for positioning an automatic thread trimmer system below the needle plate. Instead, thread trimmers typically have been positioned above the needle plate congesting the working space above the needle plate, such as, for example, the machine disclosed in U.S. Pat. No. 4,461,229. Accordingly, there is a need for an in-line thread trimmer system that automatically cuts the threads below the needle plate and, more specifically, one that cuts the last chain stitch being sewn in a first piece of material so that it does not unravel and then positions the tail end of the threads so that they are automatically set up for the first chain stitch in the next piece of material to be sewn.

SUMMARY OF THE INVENTION

The present invention meets these needs by providing apparatus for severing the needle and looper threads of a chain stitch formed in a piece of material by a sewing machine that has an in-line looper system. The machine also comprises a needle plate and a needle carrying the needle thread through the material and the needle plate to form a needle loop below the needle plate. The needle loop has a needle side running to the needle. The looper system comprises a looper carrying the looper thread through the needle loop and a spreader receiving the looper thread from the looper.

The apparatus comprises a stationary knife positioned below the needle plate that has an edge against which the needle and looper threads are severed and a spring positioned below the stationary knife and biased in a direction toward the stationary knife. The apparatus further comprises a movable knife slidably mounted between the stationary knife and the spring which yieldingly urges the movable knife thereagainst. The movable knife has one penetrating end with a pair of axially offset barbs, a lagging barb and a leading barb closer to the penetrating end of the movable knife than the lagging barb. The apparatus finally comprises actuating means, connected to the other end of the movable knife, for extending the penetrating end through the needle loop so that the leading barb hooks the needle side of the needle loop and the lagging barb hooks the looper thread and retracting the penetrating end far enough beyond the edge of the stationary knife to sever the needle and looper threads carried by the barbs.

The spring may be a leaf spring having one end biased against the movable knife to pinch the looper thread therebetween when the movable knife is retracted. This ensures that the looper thread is held in place after being severed. The leaf spring may also extend beyond the edge of the stationary knife to pinch the looper thread and hold it in place before being severed. The appratus may further comprising pulling means, positioned adjacent the looper, for pulling enough slack in the looper thread so that the looper forms a feed loop in the looper thread being positioned within the needle loop when penetrated by the looper to form the first stitch in a next piece of material to be sewn. The pulling means comprises a U-shaped finger, having one end hooked around the looper thread, and looper actuating means, connected to the other end of the finger, for moving the finger to pull the required slack in the looper thread.

The present invention also meets these needs by providing a method for severing the needle and looper threads of a chain stitch formed in a piece of material by a sewing machine having an in-line looper system. The method comprising the steps of severing the needle side of the needle loop below the needle plate, severing the looper thread below the needle plate leaving a severed supply end from the looper, and holding the severed supply end in place for a next stitch to prevent it from slipping through the looper. The method further comprises the steps of pulling slack in the looper thread while the needle forms a next needle loop for the next stitch, forming a feed loop with the slack in the looper thread, and positioning the feed loop within the needle loop to form the next stitch.

Accordingly, it is an object of the present invention to provide a method and apparatus for severing the needle and looper threads of the last chain stitch formed in a piece of material by using an in-line looper system below the needle plate; to provide a method and apparatus that severs the threads so that they do not unravel; and to provide a method and apparatus that positions the tail ends of the threads after being severed so that they are automatically set up for the first stitch in the next piece of material to be sewn. Other objects and advantages of the invention will be apparent from the following description, the accompanying drawings, and the appended claims.

DETAILED DESCRIPTION OF THE PREFERRED EMBODIMENTS

Figure 1:
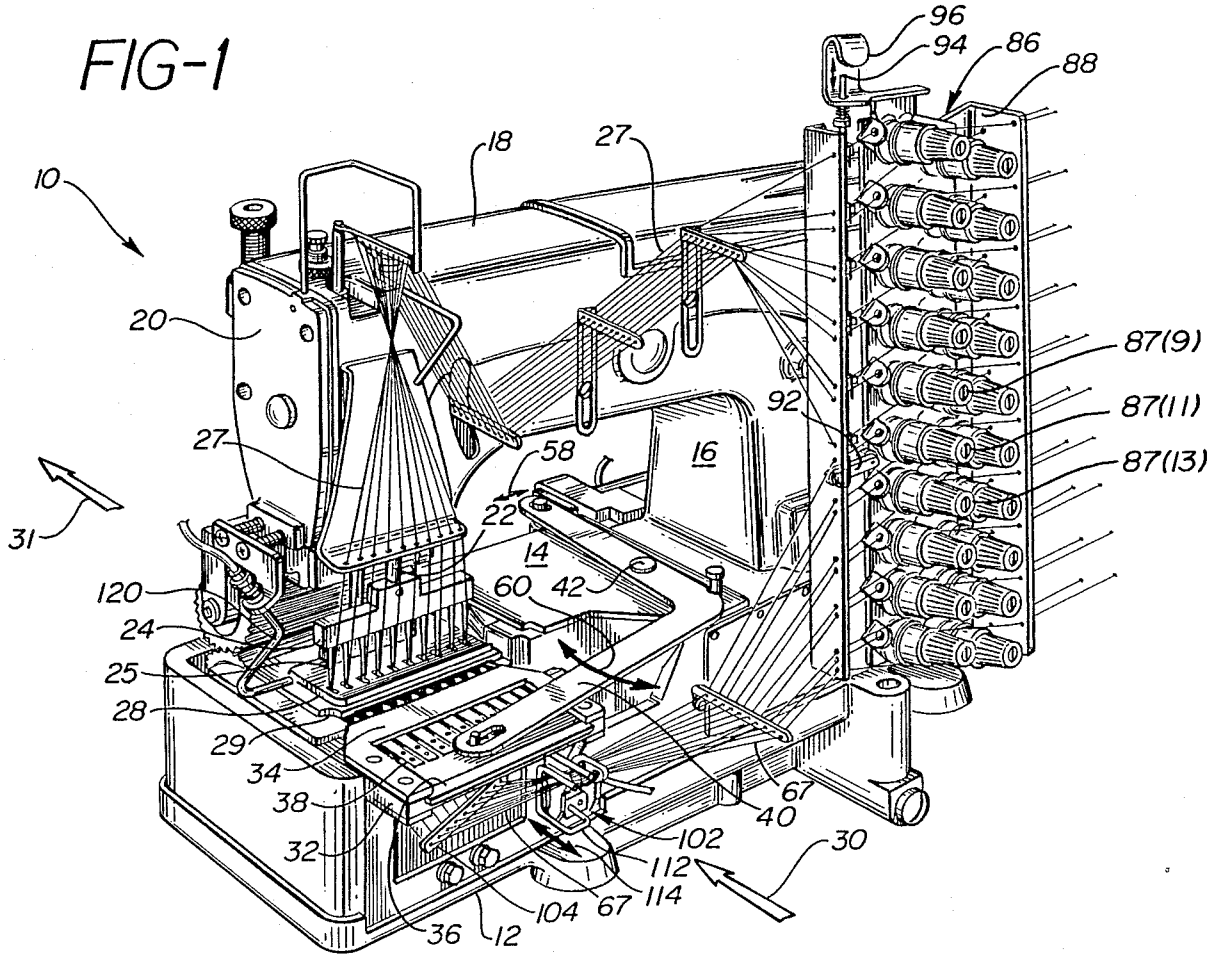
FIG. 1 is a perspective view of an in-line chain stitch sewing machine comprising a thread trimmer assembly, a needle thread pull assembly and a looper thread pull assembly in accordance with the present invention.

A chain stitch sewing machine having an in-line looper system is indicated generally at 10 in FIG. 1. Machine 10 comprises a base 12, having a bed plate 14 supported at one end and a vertical standard 16 supported at the other end, and a horizontal arm 18 extending from vertical standard 16 over bed plate 14 to support a head 20. A needle bar 22 is slidably mounted within head 20 and carries a needle holder 24 in which ten neddles 25 are secured. The needles 25 descend from a top to a bottom position through oblong openings in a foot 28 supported by head 20 and a needle plate 29 supported on bed plate 14. Each needle 25 has an eye 26 which carries a needle thread 27 as shown in FIG. 3.

Figure 2:
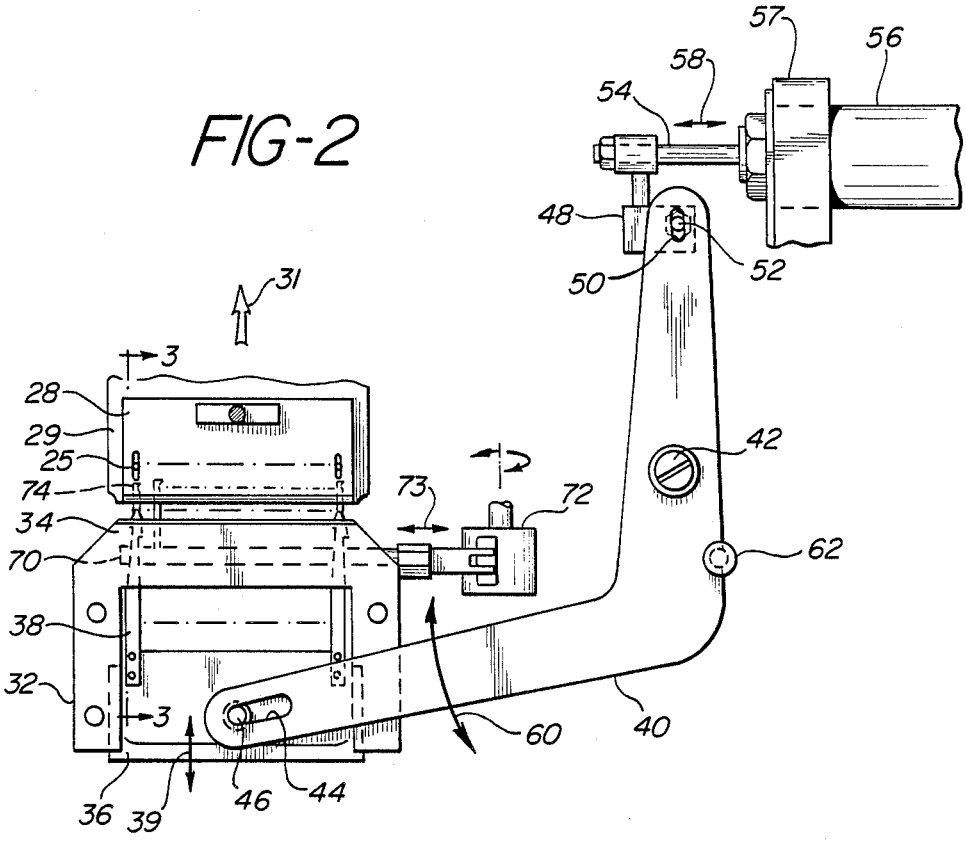
FIG. 2 is a partially schematic, top plan view of the thread trimmer assembly of FIG. 1.

Referring to FIGS. 1 and 2, the sewing direction into machine 10 is indicated by an arrow 30 and the sewing direction out of machine 10 is indicated by an arrow 31. A U-shaped slide assembly 32 is mounted on base 12 and opens against the sewing direction toward arrow 30. A stationary blade 34 is mounted on the closed end of slide assembly 32 and has a cutting edge facing the edge of needle plate 30. A knife support bracket 36 is slidably mounted within assembly 32 and carries ten arrow-shaped knives 38 which move coaxially with the sewing direction between a retracted position as shown and an extended position in which bracket 36 is moved against the closed end of slider assembly 32 as indicated by a bidirectional arrow 39.

An L-shaped actuator arm 40 is pivotally connected to bed plate 14 by a screw 42 and has one end pivotally connected to bracket 36 by a slot 44 receiving a pin 46 fixed on bracket 36. The other end of actuator arm 40 is pivotally connected to a support block 48 by a slot 50 receiving a pin 52 fixed on support block 48. The support block 48 is slidably mounted on base 12 and is connected to the piston rod 54 of a single-action compressed air cylinder 56 mounted on base 12 by bracket 57. Air cylinder 56 moves support block 48 in a direction transverse to the sewing direction as indicated by a bidirectional arrow 58 and rotates actuator arm 40 as indicated by bidirectional arrow 60 to move knives 38 between the retracted and extended positions. A stop pin 62 affixed to bed plate 14 prevents actuator arm 40 from pulling bracket 36 out of assembly 32.

Figure 3:
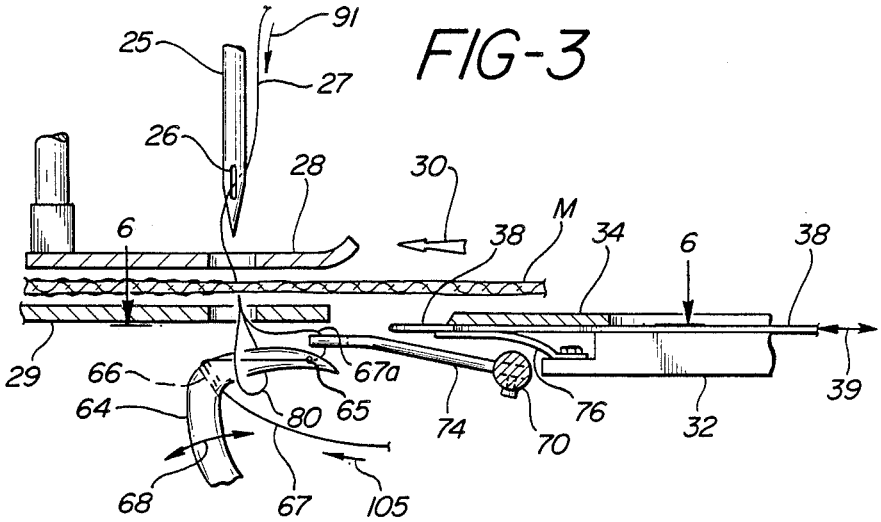
FIG. 3 is a cross section of the thread trimmer assembly taken along line 3—3 of FIG. 2.

Referring in more detail to FIGS. 2 and 3, ten loopers 64 are journaled within base 12 under needle plate 29, each one cooperating with a corresponding needle 25 to form a type 401 stitch, i.e., a double chainstitch. Each looper 64 has an eye 65 and a guide eyelet 66 which carry a looper thread 67. Looper 64 moves in a direction coaxially with the sewing direction as indicated by a bidirectional arrow 68. A spreader support shaft 70 is actuated by a mechanism 72 to move in a direction transverse to the sewing direction as indicated by an arrow 73 and carries ten spreaders 74, each one cooperating with a corresponding looper 64 to form the type 401 stitch in the conventional fashion.

Referring in more detail to FIG. 3, each knife 38 slides between stationary blade 34 and a leaf spring 76 which is supported by the front portion of U-shaped slide assembly 32. Leaf spring 76 presses knife 38 against the underside of stationary blade 34 and cooperates with knife 38 to cut the threads during a trimming mode which will be described below in more detail. It should be noted, however, that knives 38 have been designed to grab the threads and drag them back to be cut by stationary blade 34 in cooperation with leaf springs 76 in a small trimming space defined as being below neddle plate 29 and above spreaders 74. Unlike any in-line looper machine in the prior art that trims the threads in the conjested work space above the needle plate, the present invention provides a machine that cuts the threads below the needle plate to reduce conjestion in the work space.

Figure 14:
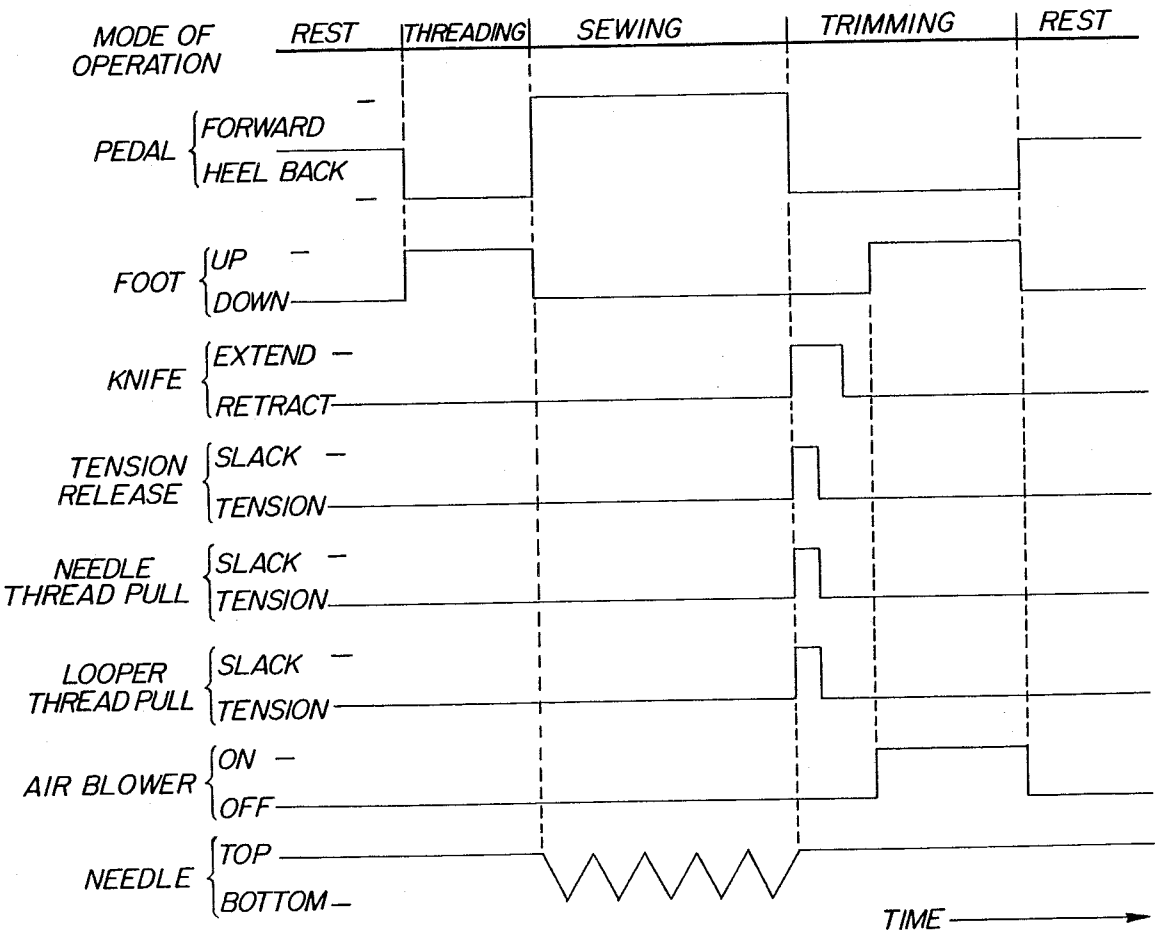
FIG. 14 is a timing chart showng the the sequence of operation for various components of the sewing machine of FIG. 1.

In operation, machine 10 operates in three modes: the threading mode, the sewing mode and the trimming mode just referred to above. The threading and sewing modes used to form double chain stitches is well known in the art, but will be described briefly to the extent necessay for a clear understanding of the invention. Referring also to FIG. 14, needle 25 is always in the top position when machine 10 is at rest. When the machine pedal (not shown) is heeled back while machine 10 is in the rest position, the electronic control unit (not shown) of machine 10 generates a first foot-control signal which actuates a solenoid (not shown) that raises foot 28. A first piece of material M is inserted in the direction indicated by arrow 30 between foot 28 and needle plate 29 while needle 25 remains in the top position as shown. When the sewing machine pedal is pressed forward, foot 28 drops and presses against the material M and needle 25 descends to commence sewing in the sewing mode.

The needle 25 descends from the top position and pierces the material M carrying thread 27 therethrough, while looper 64 moves back out of the path of the descending needle 25. When needle 25 reverses direction and returns to the top position, a needle loop 27*a* is formed below needle plate 29 and has a needle side 27*n* and a material side 27*m* (see also FIG. 10). The needle side 27*n* is the supply of needle thread 27 from needle 25 and the material side 27*m* is the demand side connected to the previous stitch in the material M. As needle 25 retracts, looper 64 penetrates needle loop 27*a* carrying looper thread 67 therethrough to form a loop 67*a* which is grabbed by a notch in spreader 74 (see also FIGS. 11–13). Spreader 74 moves way from the sewing path (to the right in FIG. 2) and pulls loop 67*a* in the same direction. Needle 25 reaches the top position and descends again to form another stitch in the material M. Sewing is stopped when the sewing machine pedal is again heeled back. When the pedal is heeled back while machine 10 is sewing, the trimming mode commences automatically and will be discussed below in more detail.

Figure 4:
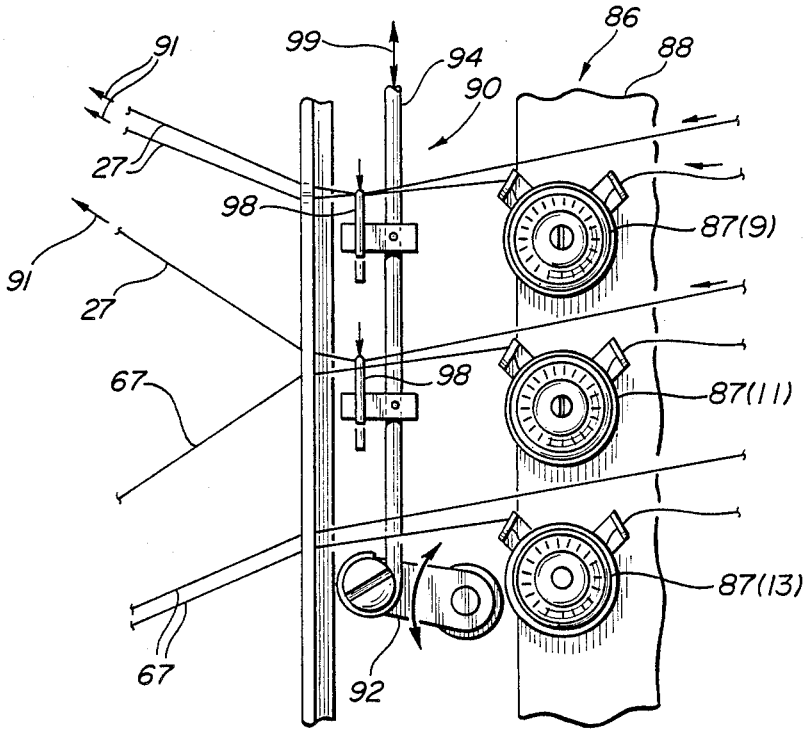
FIG. 4 is a fragmentary elevational view showing a portion of the needle thread pull assembly of FIG. 1.

Referring in more detail to FIGS. 1 and 4, needle thread 27 is provided to needle 25 through a thread tension assembly 86 and needle thread pull assembly 90 as indicated by arrows 91, both of which are mechanically actuated by a linkage (not shown) connected to piston rod 54. Tension assembly 86 comprises twenty tension spools 87, one for each of the ten needle threads 27 and the ten looper threads 67 such as 87(9), 87(11) and 87(13), mounted on a tension plate 88 supported by vertical standard 16. Tension spools 87 normally provide tension to the threads, but release the tension when actuated by air cylinder 56. Needle thread pull assembly 90 comprises an actuator arm 92 which is rotated by the linkage as indicated by a bidirectional arrow 93 and a riser bar 94, one end of which is pivotally connected to the end of actuator arm 92 and the other end of which is slidably connected to a bracket 96 mounted on tension plate 88. Riser rod 94 carries six U-shaped fingers 98 which hook over one or two of the needle threads 27 and is normally in the up position as shown. When air cylinder 56 is actuated, however, actuator arm 92 rotates riser rod 94 down in the direction indicated by arrow 99 so that it pulls extra slack in needle thread 27.

Figure 5:
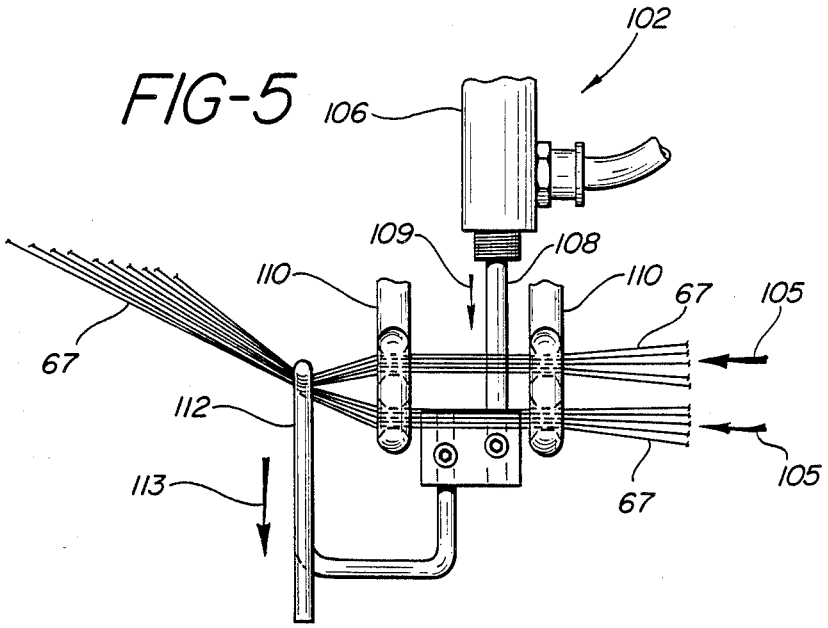
FIG. 5 is a partially schematic top plan view of the looper thread pull assembly of FIG. 1.

Referring in more detail to FIGS. 1 and 5, looper thread 67 is provided to looper 24 through thread tension assembly 86, as described above, and a looper thread pull assembly 102 and eyelet guide 104, both of which are mounted on base 12, as indicated by arrows 105. Looper thread pull assembly 102 comprises an air cylinder 106 which actuates a piston rod 108 in a direction indicated by arrow 109 and simultaneously with air cylinder 56. Looper thread pull assembly 102 also comprises thread eyelets 110 for guiding threads 67 and U-shaped finger 112 which hooks over threads 67. Finger 112 is normally in the up position as indicated in FIG. 5, but is pushed down by piston rod 108 as indicated by arrow 113 in FIG. 5, or out as indicated by bidirectioal arrow 114 in FIG. 1, so that it pulls extra slack in looper threads 67. Unlike the needle thread pull assembly 90, the looper thread pull assembly 102 must be positioned close to looper 64 to minimize the friction loss therebetween so that the necessary slack is formed adjacent looper 64 when needed for the trimming mode as will be described below in more detail.

Figure 6:
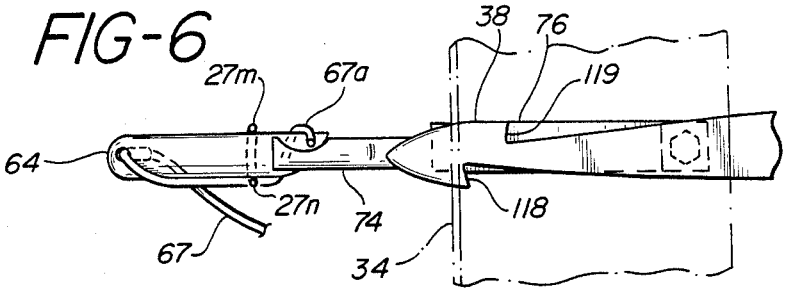
FIGS. 6—9 are partially schematic, top plan views of a single knife and looper of the thread trimmer assembly, where the knife is shown at different positions, taken along the line 6—6 of FIG. 3.
Figure 7:
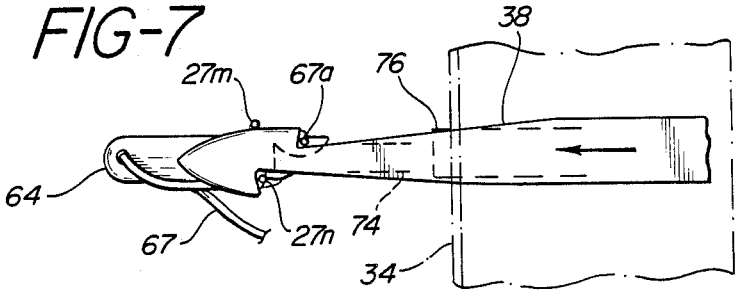

As mentioned above, the trimming mode commences automatically when the sewing machine pedal is heeled back while machine 10 is in the sewing mode. At this point needle 25 automatically returns to the top position so that the first piece of material M can be romoved and another inserted to be sewn. The electronic control of machine 10 generates a cut signal to a solenoid A (not shown) which provides compressed air to air cylinders 56 and 106 and initiates four events as follows. First, knives 38 are moved from the retracted position shown in FIG. 6 to the extended position shown in FIGS. 7 and 10. The end of each knife 38 extending toward needle loop **27*a* is shaped like the tip of an arrow having a pair of axially offset barbs, a leading barb 118 closer to the tip and a lagging barb 119. The barbs are offset so that leading barb 118 grabs needle side 27*n* of needle loop 27*a* and lagging barb 119 grabs looper thread 67 when knives 38 reach the extended position, while leaving material side 27*m* of needle loop 27*a*** intact.

Figure 8:
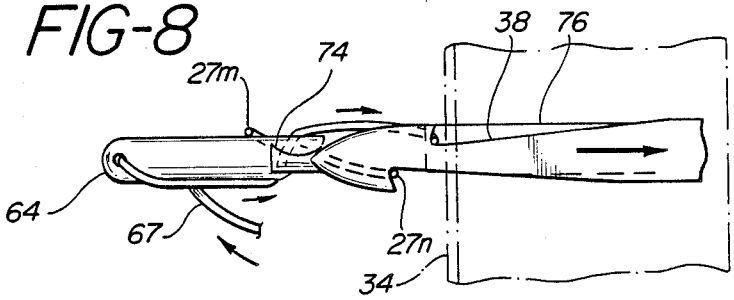
Figure 11:
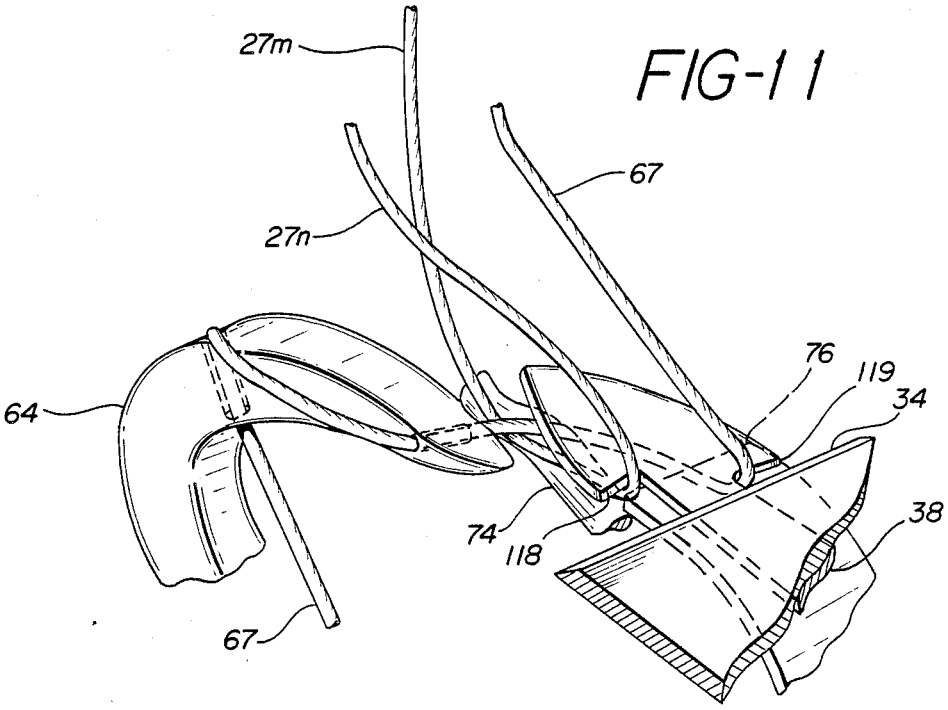

Second, thread tension assembly 86 reduces the tension in the needle and looper threads so that thread pull assemblies 90 and 102 can pull extra slack in both the needle and looper threads. Third, needle-thread pull assembly 90 is actuated to pull extra needle thread 27 as described above so that enough thread is available for knives 38 when they are retracted as shown in FIGS. 8 and 11. Fouth, looper-thread pull assembly 102 is actuated to pull extra looper thread 67 as described above so that enough thread is available for knives 38 when they are retracted as shown in FIGS. 8 and 11. After slack is provided to both needle threads 27 and looper threads 67, both of the thread pull assemblies 90 and 102 return to their original positions and thread tension assembly 86 again applies tension thereto.

Figure 9:
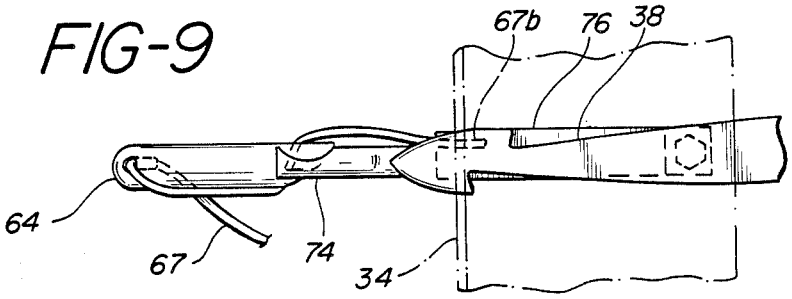
Figure 12:
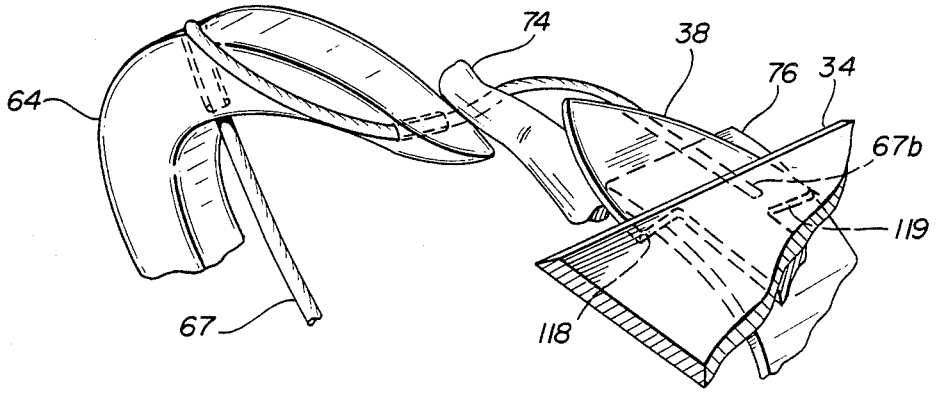

When the air to cylinder 56 is shut off, knives 38 retract as shown in FIGS. 8 and 11. The barbs pull the extra slack in the needle and looper threads 27 and 67 through needle 25 and looper 64, respectively, toward the cutting edge of stationary knife 34. As knives 38 continue to retract, looper thread 67 is severed between lagging barb 119 and stationary knife 34 so that the severed supply end **67*b* of looper thread 67 is pinched between knife 38 and spring 76 as shown in FIGS. 9 and 12. Thus, the supply end of looper thread 67 does not slip back through looper 64 and is held in place for the first stitch in the next piece of material to be inserted. When knives 38 are fully retracted as shown in FIGS. 9 and 12, the needle side 27*n* of needle loop 27*a* is severed between leading barb 118 and stationary knife 38 so that the material side 27*m* is longer than the severed needle side 27*n* of needle thread 27. The extra length in the material side 27*m* of needle thread 27** is necessary to better ensure that the knot formed in the last stitch in material M is locked so that it will not come undone.

As mentioned above, the trimming mode commences automatically when the sewing machine pedal is heeled back while machine 10 is in the sewing mode. At this point needle 25 automatically returns to the top position so that the first piece of material M can be removed when foot 28 is raised and another piece of material can be inserted. The electronic control of machine 10 provides a time-delayed second foot-control signal to solenoids B and C (not shown) which lifts foot 28 and actuates an air blower (not shown) via an air blower tube 120 (FIG. 1). The signal is delayed until after knives 38 have been retracted. When material M is removed, the material side **27*m* of needle thread 27 and the tail end of looper thread 67 are removed with material M and the needle side 27*n* of needle thread 27 is blown above needle plate 29 by the air blower to be in position for the first stitch in the next piece of material inserted into machine 10. This leaves only the severed supply end 67*b* below needle plate 29 as shown in FIG. 12. After material M is removed, the pedal is returned to the rest position from being heeled back which lowers foot 28** and turns off the air blower.

Unlike prior chain stitch, in-line machines, machine 10 of the present invention cuts the thread for the last stitch below needle plate 29 to keep the work area above the plate uncluttered. Furthermore, machine 10 cuts the thread automatically without the intervention of an operator. Additionally, knives 38 and 34 cut only one side of the needle thread loop **27*a* so that the tail end of the needle thread 27*n* better locks the last stitch in material M. Another feature of the present invention is that the needle and looper threads 27 and 67** are automatically set up for the first stitch in the next piece of material to be sewn.

Figure 10:
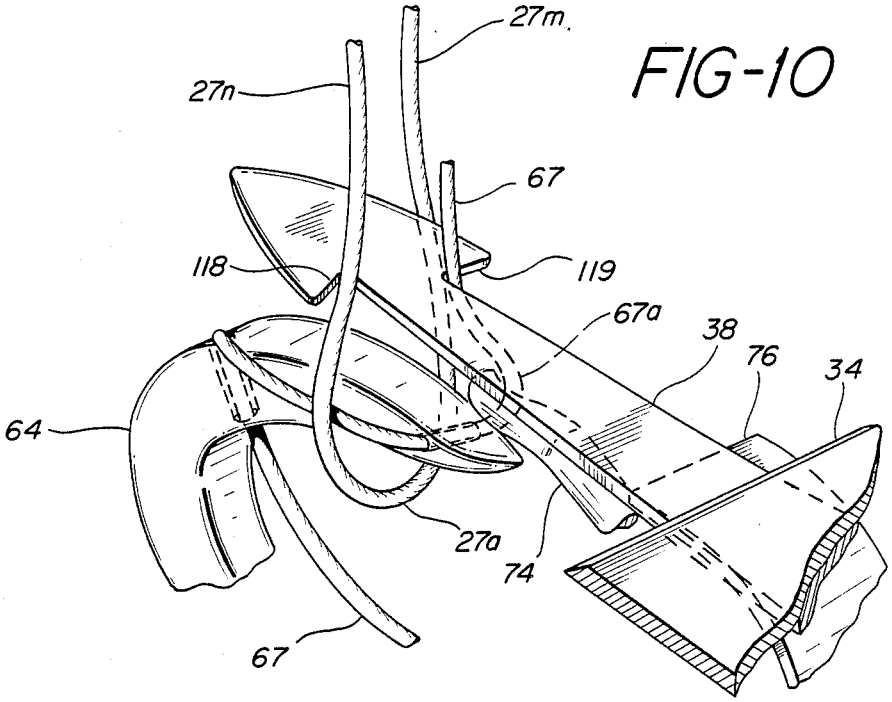
FIGS. 10—13 are partially schematic, perspective views of the single knife and looper of the thread trimmer assembly, wherein FIGS. 10—12 correspond to FIGS. 7—9, respectively.
Figure 13:
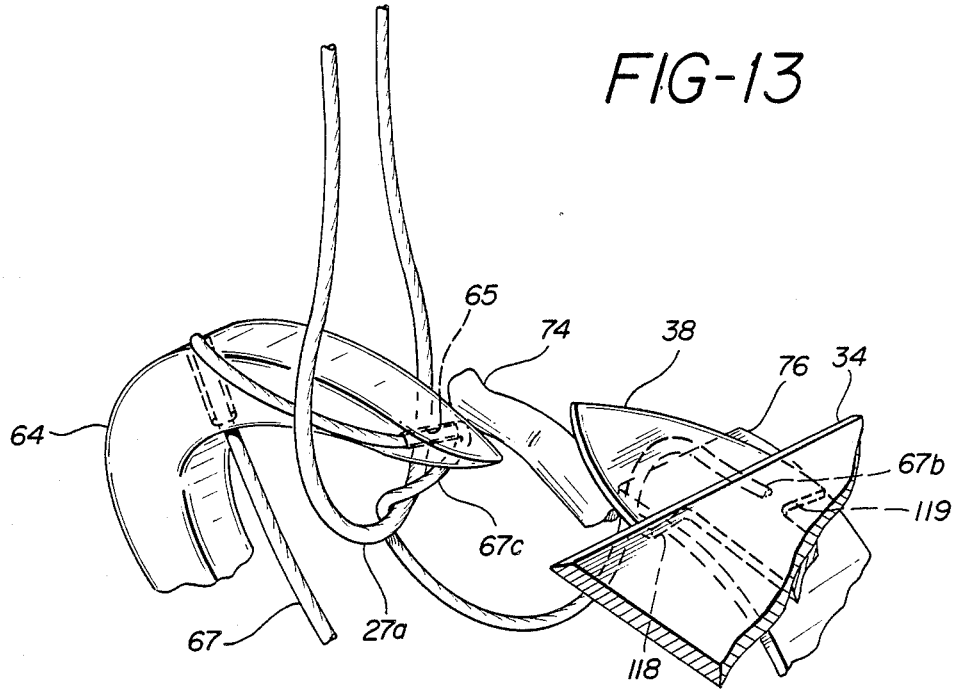

When needle 25 forms the first needle loop 27a, the normal loop 67a in looper thread 67 cannot be formed as shown in FIG. 10 because the severed supply end 67b is being held in place by knife 38 of the present invention as shown in FIG. 13. Looper thread pull assembly 102, however, pulls enough extra slack in looper thread 67 so that looper 64 can pull the slack when it rocks back and form a feed loop 67c when it penetrates needle loop 27a as shown in FIG. 13. As refered to above, looper thread assembly 102 must be close enough to looper 64 to minimize the number of thread-guiding surfaces that create friction so that the slack does form between looper eye 65 and knife 38. After the first stitch is formed, the material moves in the direction indicated by arrows 30 and 31 and pulls the severed supply end 67b with it so that subsequent stitches will be formed as shown in FIG. 10 and as described above.

Having described the invention in detail and by reference to preferred embodiments thereof, it will be apparent that other modifications and variations are possible without departing from the scope of the invention defined in the appended claims.

What is claimed is:

1. Apparatus for severing the needle and looper threads of a chain stitch formed in a piece of material by a sewing machine having a needle plate, a needle carrying the needle thread through the material and the needle plate to form a needle loop of needle thread therebelow having a needle side running to the needle, a looper carrying the looper thread through the needle loop, and a spreader receiving the looper thread from the looper, said apparatus comprising:

a stationary knife positioned below the needle plate and having an edge against which the needle and looper threads are severed;

a spring positioned below said stationary knife and biased in a direction toward said stationary knife;

a movable knife slidably mounted between said stationary knife and said spring yieldingly urging said movable knife thereagainst and having one penetrating end with a pair of axially offset barbs, a lagging barb and a leading barb closer to said penetrating end of said movable knife than said lagging barb; and actuating means, connected to the other end of said movable knife, for extending said penetrating end through the needle loop so that said leading barb hooks the needle side of the needle loop and said lagging barb hooks the looper thread and retracting said penetrating end far enough beyond said edge of said stationary knife to sever the needle and looper threads carried by said barbs.

2. Apparatus as recited in claim 1, wherein said spring is a leaf spring having one end biased against said movable knife to pinch the looper thread therebetween when said movable knife is retracted, whereby the looper thread is held in place after being severed.

3. Apparatus as recited in claim 2, wherein said leaf spring extends beyond said edge of said stationary knife to pinch the looper thread and hold it in place before being severed.

4. Apparatus as recited in claim 2, further comprising pulling means, positioned adjacent said looper, for pulling enough slack in the looper thread so that the looper forms a feed loop in the looper thread being positioned within the needle loop when penetrated by the looper to form the first stitch in the next piece of material to be sewn.

5. Apparatus as recited in claim 4, wherein said pulling means comprises a U-shaped finger, having one end hooked around the looper thread, and looper actuating means, connected to the other end of said finger, for moving said finger to pull the required slack in the looper thread.

6. A method for severing the needle and looper threads of a chain stitch formed in a piece of material by a sewing machine having a needle plate, a needle carrying the needle thread through the material and the needle plate to form a needle loop of needle thread therebelow having a needle side running to the needle, a looper carrying the looper thread through the needle loop, and a spreader receiving the looper thread from the looper, said method comprising the steps of:

positioning a stationary knife below the needle plate so that the edge thereof is oriented to sever the needle and looper threads;

positioning a spring below the stationary knife so that is biased in a direction toward the stationary knife; slidably mounting a movable knife between the stationary knife and the spring which yieldingly urges the movable knife thereagainst, the movable knife having one penetrating end with a pair of axially offset barbs, a lagging barb and a leading barb closer to the penetrating end of the movable knife than the lagging barb;

extending the movable knife through the needle loop so that said leading barb hooks and the needle side of the needle loop and the lagging barb hooks the looper thread; and retracting the penetrating end far enough beyond the edge of the stationary knife to sever the needle and looper threads carried by the barbs.

7. A method as recited in claim 6, wherein the spring pinches the looper thread against the movable knife when the movable knife is retracted to hold the looper thread in place after being severed.

8. A method as recited in claim 7, wherein the spring pinches and holds the looper thread before the looper thread is severed.

9. A method as recited in claim 7, further comprising the steps of pulling slack in the looper thread, using the slack to form a feed loop in the looper thread, and positioning the feed loop within the needle loop to form the first stitch in the next piece of material to be sewn.

10. A method for severing the needle and looper threads of a chain stitch formed in a piece of material by a sewing machine having a needle plate, a needle carrying the needle thread through the material and the needle plate to form a needle loop of needle thread therebelow having a needle side running to the needle, an in-line looper system including a looper carrying the looper thread through the needle loop, and a spreader receiving the looper thread from the looper, said method comprising the steps of:

severing the needle side of the needle loop below the needle plate;

severing the looper thread below the needle plate leaving a severed supply end from the looper; and holding the severed supply end in place for a next stitch to prevent it from slipping through the looper.

11. A method as recited in claim 10, further comprising the steps of pulling slack in the looper thread while the needle forms a next needle loop for the next stitch, forming a feed loop with the slack in the looper thread, and positioning the feed loop within the needle loop to form the next stitch.

* * * * *